United States Patent [19]

Dieudonné

[11] Patent Number: 5,003,284

[45] Date of Patent: Mar. 26, 1991

[54] INFRARED RADIATOR

[75] Inventor: Walter Dieudonné, Kälberau, Fed. Rep. of Germany

[73] Assignee: Heraeus Quarzschmelze GmbH, Hanau, Fed. Rep. of Germany

[21] Appl. No.: 395,481

[22] Filed: Aug. 18, 1989

[30] Foreign Application Priority Data

Dec. 9, 1988 [DE] Fed. Rep. of Germany ..... 3841448

[51] Int. Cl.[5] ..... H01C 1/024

[52] U.S. Cl. ..... 338/237; 338/235; 392/407

[58] Field of Search ..... 338/234, 235, 236, 237; 219/353, 354

[56] References Cited

U.S. PATENT DOCUMENTS

| | | | |
|---|---|---|---|
| 1,525,831 | 2/1925 | Steiner et al. | 338/236 |
| 1,680,104 | 8/1928 | Head | 219/354 X |

FOREIGN PATENT DOCUMENTS

| | | | |
|---|---|---|---|
| 445331 | 6/1927 | Fed. Rep. of Germany | 219/353 |
| 1094383 | 12/1960 | Fed. Rep. of Germany | 219/353 |
| 1879140 | 4/1963 | Fed. Rep. of Germany . | |
| 353468 | 5/1961 | Switzerland | 219/353 |

*Primary Examiner*—Bruce A. Reynolds
*Assistant Examiner*—Marvin M. Lateef
*Attorney, Agent, or Firm*—Felfe & Lynch

[57] ABSTRACT

An infrared radiator includes a non-circular jacket tube made of quartz material, which may be quartz glass, the length of which is a multiple of the larger interior diameter and the interior of whch, in a sectional view, is separated into two areas, in each of which a heating wire extends in the direction of the tube axis. The heating wires are electrically conductive and connected to each other at one end of the jacket tube and lead to the exterior via connecting pieces at the other end. Two cross pieces which protrude from the inside wall of the jacket tube face each other and are directed toward the direction of the axis of the jacket tube so as to form the two areas.

10 Claims, 1 Drawing Sheet

INFRARED RADIATOR

BACKGROUND OF THE INVENTION

1. Field of the Invention

The invention relates to an infrared radiator including a non-circular jacket tube made of quartz material, which may be quartz glass, having a length which is a multiple of the larger interior diameter and having an interior which, in a cross sectional view, is subdivided into two areas. In each area, a heating wire or an electrical connecting wire extends in the direction of the axis of the tube both of which are electrically conductive connected to each other at the end of the jacket tube and leading to the exterior via connectors at the other end.

2. Description of the Prior Art

From the German utility model 1 879 140 an electrical infrared radiator is known which includes at least two radiating elements basically parallel to each other having jacket tubes of opaque quartz material, of quartz glass or of glass having a high melting point. The jacket tubes include one heating conductor, respectively, and are fused together along their contacting edge and at the end such that an infrared radiator with a one-side electrical connection is formed whose heating conductors are connected to each other.

Infrared radiators of the aforesaid kind are further known from the product information "Short Wave Infrared Radiators made of Hanau Quartz Glass", PIR 20 2C 4.88/VN Ku) of the Heraeus Quartzschmelze GmbH.

A problem with such infrared radiators having a jacket tube divided into two areas is the connection between the heating conductors passing through the two areas in those embodiments in which both electrical connections are located at the same end of the jacket tube. For this passage and connection the center piece of the jacket must be cut open by saw, for example, and after passing through the heating conductor, be fused together again. In addition to the high amount of labor involved, the material is also subject to excessively high mechanical stress.

SUMMARY OF THE INVENTION

It is an object of the invention to make an infrared radiator of the aforesaid kind which permits a simple connection of the wires and the heating conductors passing through in both areas without requiring a mechanical working of the jacket tube for this purpose.

The object is achieved in accordance with the invention in that two cross pieces project from the interior wall of the jacket tube facing each other and extending in the axial direction of the jacket tube and thus form a gap. The gap between the two cross pieces which separate the two areas permits electrically connecting the wires passed through the two areas. Such profile tubes are continuously drawn and cut to the length required for the infrared radiator. An electrical connection which can be directly made by the heating conductor passing through the two areas is then inserted in the one end of this jacket tube. The heating conductor is coupled at the opposing end of the jacket tube. If looked at from this end, having the electrical connections, the jacket tube is pressed together, for example, in the area of the opposing cross pieces such that these cross pieces contact each other and the wire and the electrical connecting piece are supported. Hence, mechanical procedures are not required to incorporate such a connecting piece in the jacket tube. At the same time, the cross pieces ensure a high stability of the jacket tube although there is no connection made between the cross pieces.

In the area of the electrical connection the cross pieces can be pressed together over a larger area and/or fused together such that the electrical connection is embedded between the cross pieces and hence, cannot be displaced.

A further possibility for an electrical connection between the two heating conductors is using a support element which is inserted into the jacket tube from the open side of the jacket tube and anchored therein, for example, made of quartz glass. The wire or the heating conductor is then passed through via this support element before the support element is embedded and fused to the jacket tube. The embedding can be carried out simultaneously with the closing of the jacket tube.

The gap formed between the cross pieces should preferably have a width of 1 mm to 5 mm and the walls of the cross pieces should have a preferred thickness between 1 mm and 5 mm. Conventionally, the interior diameter of the two areas separated by the cross pieces preferably is between 5 mm and 15 mm, respectively.

In a further preferred embodiment, the electrical connection between the wires passed through the two areas is made by a connecting piece made of electrically conductive metal to which the wires are attached. Such a connecting piece can be embedded in the crimp connection used to close the jacket tube. The thickness of such an electrical connecting piece should preferably be slightly thinner than the diameter of the wires passed through the areas. If such dimensions are given the gap between the two cross pieces can also be configured so as to be slightly thinner than the wires, thus preventing the wires from moving out of the gap if the infrared radiators are unfavorably positioned. Such a connecting piece can be configured so as to be springable (spring clip) which then gets stuck at the walls of the jacket tube.

In accordance with the invention, an infrared radiator comprises a non-circular jacket tube having an axis and an inside wall and made of quartz material and having a length which is a multiple of the larger interior diameter of said tube and having an interior which, in a sectional view, is separated in two areas. The radiator includes a heating wire extending in the direction of the tube axis in each of the two areas. The radiator also includes connecting pieces. The wires are electrically conductively connected to each other and an end of the jacket tube and at another end lead to the exterior via the connecting pieces. The radiator also includes two cross pieces which form a gap protruding from the inside wall of the jacket tube while facing each other and extending in the direction of the axis of the jacket tube so as to form the aforesaid two areas.

For a better understanding of the invention, together with other and further objects thereof, reference is made to the following description, taken in connection with the accompanying drawings, and its scope will be pointed out in the appended claims.

DESCRIPTION OF THE PREFERRED EMBODIMENT(S)

Figure 1:
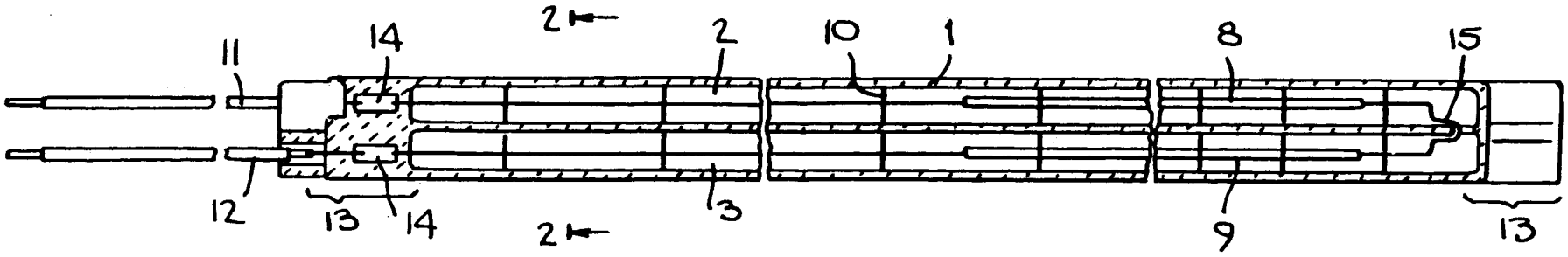
FIG. 1 is a view taken in longitudinal cross section through the infrared radiator.
Figure 2:
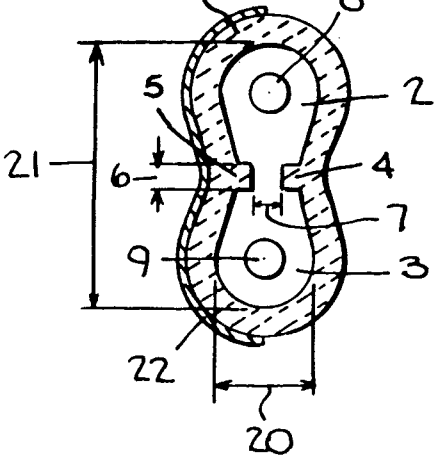
FIG. 2 is a sectional view, to an enlarged scale, through the jacket tube of the infrared radiator taken along the line II—II of FIG. 1.

Referring now more particularly to FIGS. 1 and 2, the infrared radiator is provided with a jacket tube 1 preferably made of quartz glass having an extruded profile. The interior cross section of the jacket tube 1 is separated by two opposing cross pieces 4, 5 located in the center. The walls of the cross pieces 4, 5 preferably have thickness 6 of 1.7 mm whereas the spacing between the front sides of the cross pieces 4, 5 and the gap 7 formed between these cross pieces 4, 5 preferably has a width of 4 mm.

Figure 3:
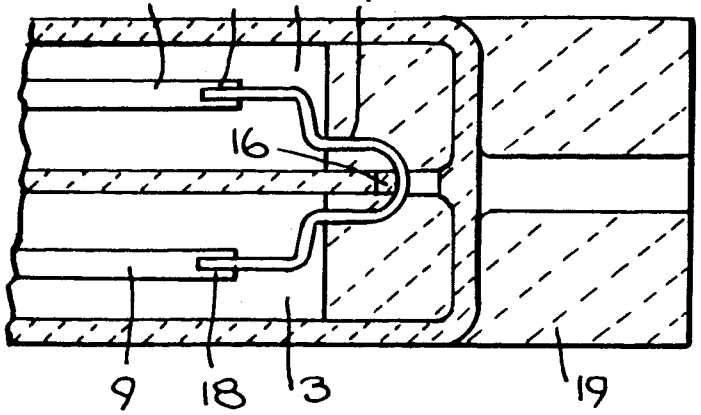
FIG. 3 is a sectional view, to an enlarged scale, of one end of the jacket tube including an electrical connecting piece.

A heating conductor 8, 9, respectively, which extends parallel to the axis of the jacket tube 1, is passed through each area 2, 3. Each of these heating conductors 8, 9 preferably is centered in the area 2, 3 by means of spacers 10 in the form of small metal plates or spiral supports which are placed thereon. While on the one end the two heating conductors 8, 9 are connected via two connector contacts 11, 12, the heating conductors 8, 9 are electrically connected to each other at the other end of the jacket tube 1. At both ends the jacket tube 1 preferably is closed by means of a crimp connection 13 which is carried out while slowly heating up the jacket tube 1. In the area of the crimp connection 13 the connector contacts 11, 12 are coupled to each other via metallic connecting pieces 14 so as to adjust the thermal expansion of this electrical passage to the thermal expansion of the jacket tube 1 preferably made of quartz glass. At the other end, as it can be seen in FIG. 1, the two heat conductors 8, 9 are electrically directly connected to each other via a wire connecting piece 15. This wire connecting piece 15 is supported in the crimped area where the cross pieces 4, 5 are in contact with each other. In FIG. 3 this contact point bears the reference numeral 16. Instead of the wire connecting piece 15 an electrical connecting piece, as FIG. 3 represents, in the form of a small metal plate 17 or wire strap can be used which extends in a U-shape between the cross pieces 4, 5 from the one area 2 to the other area 3 of the jacket tube 1. The heating conductors 8, 9 are attached to the ends 18 of the small metal plate 17. This small metal plate 17, too, can be close-lying to contact point 16 which is formed by pressing together the jacket tube 1 in the area of the cross pieces 4, 5 or it can be completely embedded in the crimp connection 13 which then must be extended corresponding to the section lining 19. In case such an embedding is used the small metal plate 17 preferably should also be made of molybdenum so as to obtain a thermal expansion corresponding to the jacket tube 1 made of quartz glass.

Referring to FIG. 2, if looked at in the direction of the cross pieces 4, 5 the smaller interior diameter 20 of the areas 2, 3 of the jacket tube 1 preferably is 10 mm; the large interior diameter 21 transverse to the cross pieces 4, 5 preferably is 20 mm. Usually, such jacket tubes 1 are provided with an exterior reflective layer 22, for example made of gold, so as to improve the radiation intensity.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. An infrared radiator comprising:

a non-circular jacket tube having an axis and an inside wall and made of quartz material and having a length which is a multiple of the larger interior diameter of said tube and having an interior which, in a sectional view, is separated in two areas;

a heating wire extending in the direction of said tube axis in each of said two areas;

connecting pieces;

said wires being electrically conductively connected to each other at an end of said jacket tube and at another end lead to the exterior via said connecting pieces; and two cross pieces which form a gap, the cross pieces protruding from said inside wall of said jacket tube while facing each other and extending in the direction of said axis of the jacket tube so as to form said two areas.

2. An infrared radiator in accordance with claim 1, in which in the area of an electrical connection between said wires the jacket tube is pressed together at least in the area of said cross pieces.

3. An infrared radiator in accordance with claim 2, in which said jacket tube is pressed together such that said cross pieces contact each other.

4. An infrared radiator in accordance with claim 3, in which areas of said cross pieces which are in contact with each other are fused together.

5. An infrared radiator in accordance with claim 1, which includes a support element having an external side and inserted in said jacket tube, said external side bearing the electrical connection of said wires.

6. An infrared radiator in accordance with claim 1, in which said gap which is formed between said cross pieces has a width of 1 mm to 5 mm.

7. An infrared radiator in accordance with claim 1, in which said cross pieces have walls having a thickness between 1 mm and 5 mm.

8. An infrared radiator in accordance with claim 1, which includes a connecting piece made of electrically conductive material for making electrical connection of said wires to which said connecting piece is attached.

9. An infrared radiator in accordance with claim 8, in which said connecting piece has a thickness which is slightly smaller than a diameter of said wires.

10. An infrared radiator in accordance with claim 8, in which at the one end where there is said electrical connection between said wires said jacket tube is closed by a crimp connection and said electrical connection between the wires is embedded in said crimp connection.

* * * * *